United States Patent [19]

Hayden et al.

[11] 4,192,374

[45] Mar. 11, 1980

[54] HEAT EXCHANGERS

[75] Inventors: Owen Hayden, Harwood; George E. Sheward, St. Annes; Derek T. Ormrod, Fulwood; Christopher R. Willby, Lymm; George F. Firth, Croft, all of England

[73] Assignee: United Kingdom Atomic Energy Authority, London, England

[21] Appl. No.: 765,745

[22] Filed: Feb. 4, 1977

[51] Int. Cl.[2] ..... F28F 9/04

[52] U.S. Cl. ..... 165/158; 29/157.4; 228/183

[58] Field of Search ..... 165/157, 158, 163; 220/DIG. 29; 29/157.4; 228/183

[56] References Cited

U.S. PATENT DOCUMENTS

| | | | |
|---|---|---|---|
| 2,303,613 | 12/1942 | Charlton | 165/163 |
| 2,502,675 | 4/1950 | Simpelaar | 165/163 |
| 2,774,384 | 12/1956 | Wallace | 165/163 |
| 2,817,499 | 12/1957 | Harding et al. | 165/163 |
| 2,928,166 | 3/1960 | Worn | 220/DIG. 29 |
| 3,545,536 | 12/1970 | Peters | 165/160 |
| 3,831,673 | 8/1974 | Hayden et al. | 165/158 |
| 3,854,528 | 12/1974 | Pouderoux et al. | 165/158 |
| 3,937,277 | 2/1976 | Krolmann et al. | 165/162 |
| 3,945,431 | 3/1976 | Straub | 165/158 |

*Primary Examiner*—Ira S. Lazarus

*Attorney, Agent, or Firm*—Larson, Taylor and Hinds

[57] ABSTRACT

A tube-in-shell heat exchanger for effecting heat exchange between steam conducted by the heat exchange tubes and liquid metal conducted through the shell. The tubes penetrate the tube sheet by means of clearance apertures and are sealed thereto with thermal sleeves which are brazed to the tubes so that fusion welds are avoided in the sodium/water barrier.

12 Claims, 12 Drawing Figures

HEAT EXCHANGERS

BACKGROUND OF THE INVENTION

This invention relates to tube-in-shell heat exchangers and is primarily directed to exchangers for effecting heat exchange between liquid metal and water.

Liquid metal, such as sodium, is used in the nuclear reactor art as a coolant for fast breeder reactors mainly because of its high thermal capacity. Because of the high operating temperatures and the aggressive nature of the liquid metal heat exchangers for use as superheaters and reheaters have been made from austenitic steel but considerable difficulty has been experienced with these units. In spite of the most stringent quality control tests during manufacture, tube-to-tube sheet joints have failed.

It is an object of the invention to provide an improved tube-in-shell heat exchanger for use in heat exchange between liquid metal and water and less prone to failures which could result in sodium water reactions.

SUMMARY OF THE INVENTION

According to the invention, in a tube-in-shell heat exchanger for use with liquid metal each heat exchange tube extends through an individual aperture in a tube sheet with clearance between the tube and the tube sheet, the tube being sealed to the tube sheet by a sleeve upstanding from a face of the tube sheet and sealed at its free end to the outer wall surface of the tube, the tube and sleeve being bonded together by an interposed bonding metal to effect the seal, the bonding metal being of a kind not requiring, for the making of the bond, any recourse to temperature as high as would be required for the making of the joint by fusion welding. In a preferred construction the sleeves are brazed to the tube and fusion welded to the tube sheet, and the heat exchange tubes are made so that within the shell they are of continuous unjointed lengths of tubing.

By adapting the tube to the tube sheet with a sleeve which is brazed to the tube, and by making the tubes within the shell of continuous unjointed lengths of tubing, fusion welds in the sodium to water barrier of the heat exchanger are avoided. Thus, according to another aspect, the invention resides in a tube-in-shell heat exchanger for use with liquid metal on the shell side, all of the tubes entering the shell by passing with clearance through individual tube sheet apertures and all being in continuous unjointed lengths over the entire run within the shell, each of the tubes being sealed at each aperture by a sleeve upstanding from a face of the tube sheet and having at its free end a joint with the outer wall surface of the tube which joint is formed by an interposed bonding metal of a kind not requiring, for the making of the bond, any recourse to temperature as high as would be required for the making of the joint by fusion welding so as to alleviate impairment of the integrity of the tube wall and hence of the barrier between the liquid metal and heat transfer medium within the tube. The construction is readily stress relieved at the brazed joint and at the fusion welded joint between the sleeve and the tube plate so that neither the tube nor tube plate are left in a highly tensile stressed condition such as would promote stress corrosion cracking. The upstanding sleeves are preferably fusion butt welded to a spigot projecting from the surface of the tube sheet.

In a tube-in-shell heat exchanger according to the invention each tube and complementary sleeve may be bonded together indirectly through a tubular transition piece which is brazed at each end to the tube and sleeve respectively, in which case the sleeve can be arranged to pass over the tube with a substantial clearance thereby facilitating assembly. The transition piece is made to make close fit with the outside surfaces of the tube and sleeve suitable for effecting brazed joints.

The invention will reside in a tube-in-shell heat exchanger comprising an elongate vessel having inlet and outlet ports for liquid metal and housing a demountable heat exchange tube assembly, wherein the heat exchange tube assembly comprises, a flanged extension forming a closure for the vessel, a bundle of U-shape heat exchange tubes having legs of unequal lengths suspended from the extension, an annular shroud arranged co-axially with the vessel and enveloping the bundle of 'U'-tubes, a cylindrical baffle suspended from the extension and defining inner and outer annular chambers in the shroud, and means for laterally supporting the 'U'-tubes extending parallel with the longitudinal axis of the vessel, a longer limb of each tube extending along the inner chamber of the shroud to penetrate an end wall of the extension which thereby forms a first tube sheet of the heat exchanger, and a shorter limb of each tube extending along the outer-chamber of the shroud to penetrate the flange of the extension which thereby forms a second tube sheet of the heat exchanger, each leg of each tube penetrating a complementary tube sheet through an individual aperture with a clearance between the tube and the tube sheet, the tube being sealed to the tube sheet by a sleeve upstanding from a face of the tube sheet and sealed at its free end to the outer wall surface of the tube, the tube and sleeve being brazed together to effect a seal.

The invention also resides in a method of constructing a tube-in-shell heat exchanger according to the preceding paragraph and wherein the tube and sleeve combinations are brazed individually using radio frequency electric induction heating means with an inert gas atmosphere enveloping the joint.

DESCRIPTION OF THE DRAWINGS

Constructions of tube-in-shell heat exchanger in accordance with the invention are described, by way of example, with reference to the accompanying drawings wherein.

DESCRIPTION OF THE PREFERRED EMBODIMENT

Figure 1:
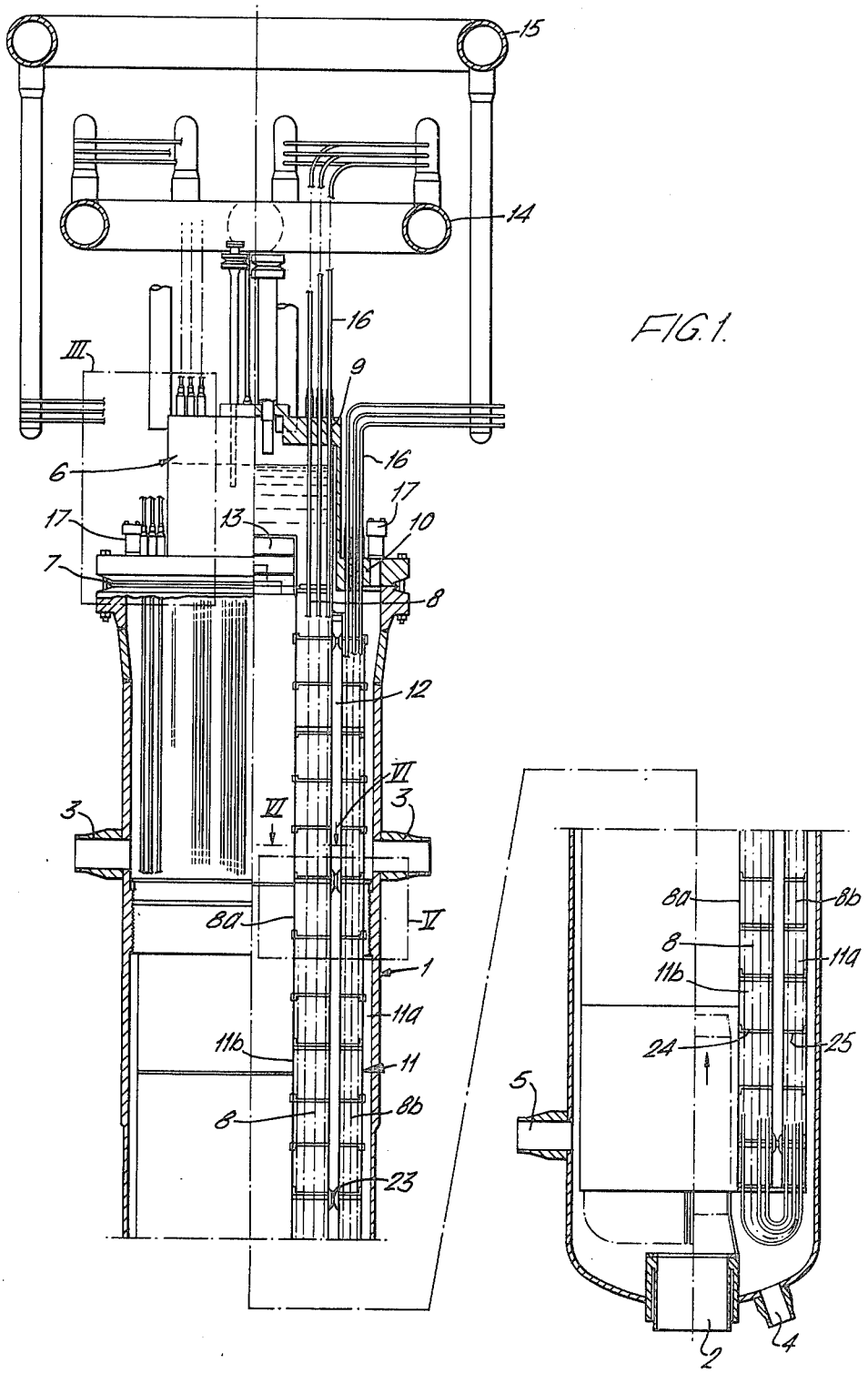
FIG. 1 is fragmentary sectional view.
Figure 2:
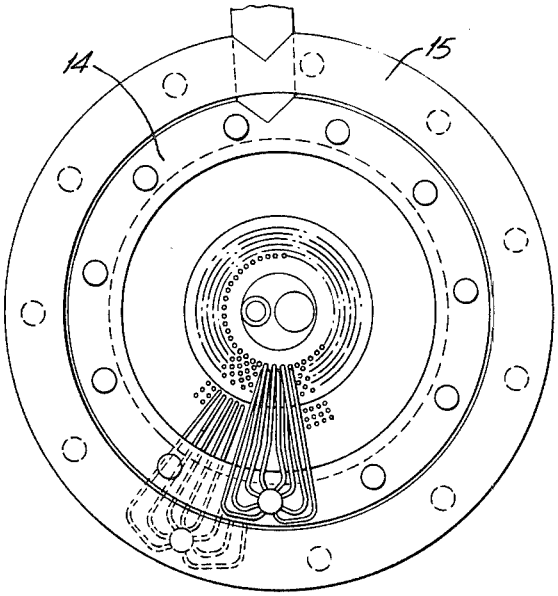
FIG. 2 is a plan view.
Figure 3:
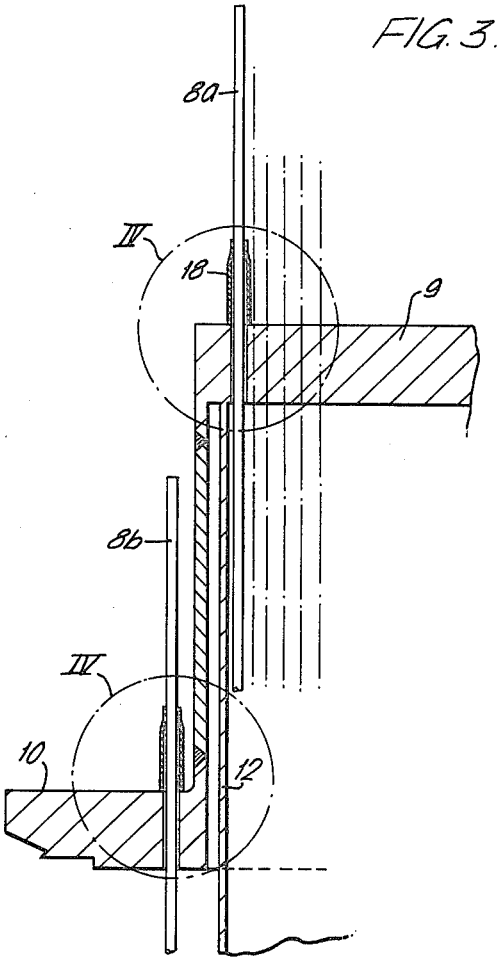
FIG. 3 is a fragmentary sectional view of a detail designated III of FIG. 1 drawn to a larger scale.

The tube-in-shell heat exchanger shown in the accompanying drawings is for use in a steam generating circuit of a liquid metal cooled fast breeder reactor installation. The disclosed heat exchanger is intended for use as a superheater but heat exchangers in accordance with the invention for use as evaporators and re-heaters are of generally similar construction. The shown heat exchanger comprises a generally cylindrical shell 1 closed at the lower end and open at a flanged upper end. The shell has a sodium inlet port 2 in the base, side outlet ports 3, a drain port 4 and a pressure release connection 5 for relief of pressure in the shell in the event of the occurrence of a sodium water reaction. The open end of the shell has a flanged cylindrical extension 6 which is closed at its upper end the flanges of the shell and extension being bolted together and peripherally sealed with a light weld at 7. The heat exchange tubes designated 8 are of 'U'-shape having legs of unequal length and are suspended within the shell from the extension 6. The longer legs 8*a* extend along the extension to penetrate the end cover which thereby forms an inner tube sheet 9 and the shorter legs penetrate the flange of the extension which forms an annular outer tube sheet 10. The tubes are enclosed by an annular shroud 11 bounded by two co-axially arranged cylindrical members 11*a*, 11*b*, and there is a cylindrical baffle 12 carried from the inner tube sheet (as shown in FIG. 3) which extends co-axially within the shroud 11 between the long and short legs of the tubes. The sodium flow path from the inlet port at the base of the shell is upwardly through the inner cylindrical member 11*b* of the shroud to a distributor 13 in the extension 6 thence downwardly over the longer legs of the tubes, upwardly over the shorter legs thence to leave the shell by way of the outlet ports 3. The long and short legs of the 'U'-tubes are connected to external outlet and inlet steam headers 14 and 15 respectively shown in FIGS. 1 and 2. The 'U'-tubes 8 are of 9% chrome alloy steel but because of the difficulty in welding and heat treating this material on site, transition pieces designated 16 of 1% chrome alloy steel are interposed between the tube sheets and the headers. 1% chrome alloy tails can be attached to the 9% chrome alloy tube ends and header tail pipes and heat treated during manufacture. Inter-connection can be made readily on site, no further heat treatment being required. Argon cover gas is disposed above the sodium levels on each side of the cylindrical baffle 12 and branches, such as those designated 17, are provided to enable the cover gas to be checked for hydrogen content and to enable the sodium levels to be detected.

Figure 4:
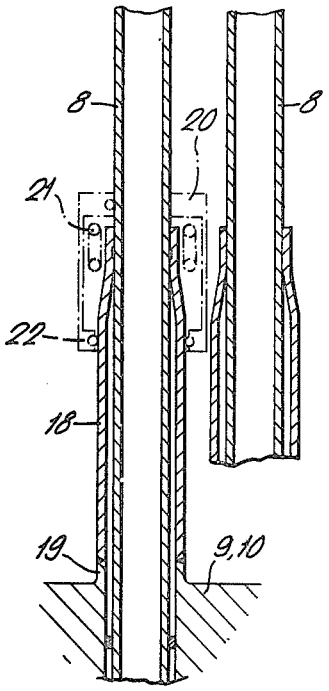
FIG. 4 is a fragmentary sectional view of a detail designated IV in FIG. 3, drawn to an even larger scale.

As shown in FIGS. 3 and 4, each of the tubes 8 passes through its relevant tube sheet 9, 10 by way of a clearance aperture and is sealed to the tube sheet by a sleeve 18. To effect the seal the lower end of each sleeve is butt welded to an externally projecting spigot 19 bounding the aperture on the upper face of the tube sheet and the free end of the upstanding sleeve is brazed to the outside wall surface of the tube. Access for welding the sleeves to their respective spigots on each tube sheet is gained from inside the sleeves prior to passing the tubes through and the welds are all stress relieved simultaneously by heating the entire tube sheet. The brazed joints are made individually and to make a brazed joint the outer surface of the tube and the inner surface of the free end of the sleeve are first carefully cleaned in the joint areas. For successively making each joint a strip of filler material designated 20 (FIG. 4) is attached to the bore of the sleeve. The tube is threaded through the sleeve to a position just beyond that at which the joint between sleeve and tube is to be made and by means of an internally operating roll the tube is swaged outwardly for effecting a close fit with the free end of the sleeve. The tube is then withdrawn into the sleeve to engage the expanded region of the tube with the free end of the sleeve. An R/F induction heating coil (also shown in FIG. 4 and designated 21) is placed about the sleeve and heat is applied for approximately one minute to melt the filler the joint area being enclosed by a sealed cover designated 22 which is charged with argon to prevent oxidation of the materials.

The filler material is Nicrobraz 135, a nickel based alloy (Nicrobraz is a registered trade mark), and the brazing operation is carried out at a temperature within the range 1050° C.–1200° C. The joints are subsequently stress relieved.

Each braze is ultrasonically checked for bond area, helium leak tested and visually examined to ensure a satisfactorily sealed joint. The appearance of filler material at the extreme end of the sleeve bears witness to the effectiveness of the bond. The tubes 8 are made from continuous lengths of tubing so that no joints occur within the shell whereby, in the event of a defect occuring, sodium could come into contact with water.

Figure 5:
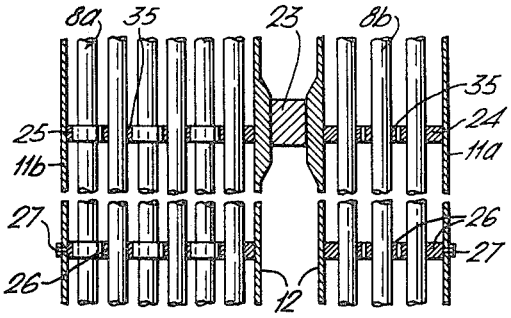
FIG. 5 is a fragmentary sectional view of a detail designated V in FIG. 1 and drawn to a larger scale.
Figure 6:
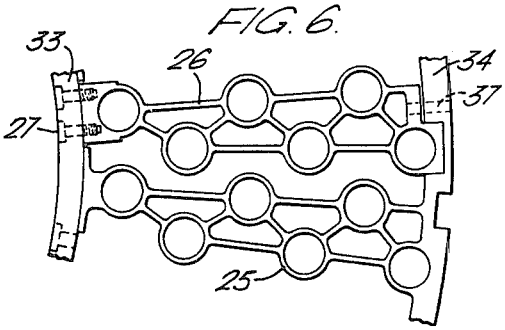
FIG. 6 is a fragmentary plan view on line VI—VI of FIG. 1, FIGS. 7 and 8 are fragmentary sectional views of alternative features.

The complex of tubes is laterally supported by the cylindrical baffle 12 which is suspended from the underside of the inner tube sheet 9. The baffle is double walled to reduce heat transfer therethrough and there are pads 23 (shown in FIG. 5) disposed at intervals between the inner and outer walls to space them apart during handling operations. The pads 23 are welded to the inner wall but have sliding contact with the outer wall to accommodate differential thermal linear expansion of the walls in the axial direction. Inner and outer annular cellular grid plates 24, 25 for laterally supporting the heat exchange tubes 8 are secured within the annular shroud at axially spaced intervals. Each plate comprises inner and outer rims 33, 34 inter-connected by cellular spokes 35 as shown in FIG. 6 which illustrates a fragment of an inner cellular plate 24. The spokes 35 have apertures each for accommodating a single tube with clearance. Between the spokes movable anti-vibration plates 26 are disposed the plates having clearance apertures for the tubes. The anti-vibration plates 26 are slidably supported from the outer rim 34 on two (vertically spaced) radially projecting dowels 37 and are secured to the inner rim 33 by set bolts 27 which can be adjusted to move the plates radially inwardly or outwardly. The grids are arranged in series in the shroud in such a manner that each tube leg passes alternately through a spoke 35 and an anti-vibration plate 26. By displacing the anti-vibration plates radially the tubes can be loaded laterally to restrain vibrations. In an alternative construction inner and outer annular, cellular grid plates 24, 25 are secured to the inner and outer walls of the cylindrical baffle 12 at axially spaced intervals, the grid plates having large clearance apertures or slots for passage of the tubes. The grid plates each support a group of angularly spaced anti-vibration plates through which the tubes also pass with clearance. The anti-vibration plates are arranged to be movable radially relative to the grid plates by means of set bolts extending through the cylindrical members 8*a*, 8*b* of the shroud so that they can be pulled or pushed radially against the tubes 8 to prevent vibration. The direction of the applied movement to load the tubes can be alternated inwardly and outwardly. The cylindrical members 8*a*, 8*b* of the shroud have removable sections (not shown) to give access to the anti-vibration plates which are also arranged to be axially displaceable to enable the contact area of the tubes to be examined for fretting during post operation inspection of the heat exchanger and, if the need arises, to be repositioned to provide new areas of contact with the tubes.

Figure 9:
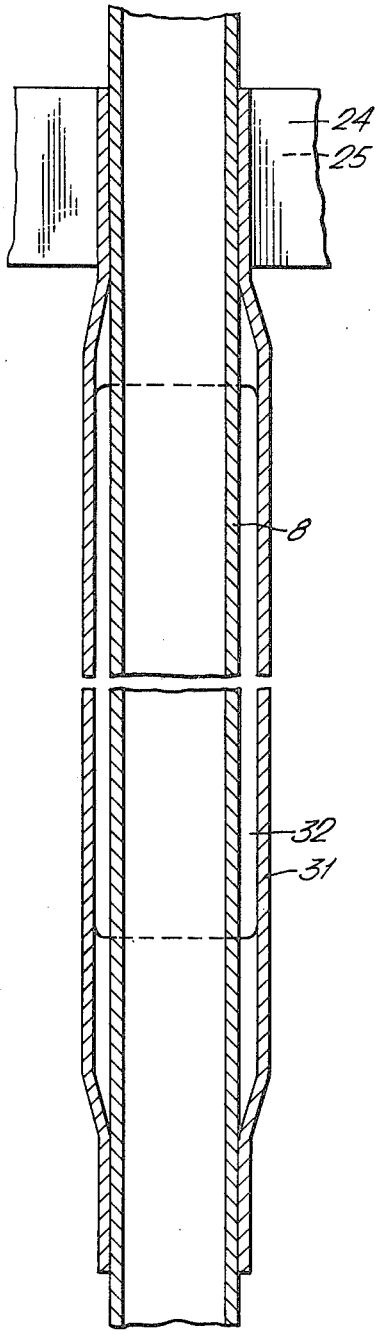
FIGS. 9, 10, 11 and 12 are fragmentary views of two alternative support arrangements for the lower ends of the heat exchange tubes.
Figure 10:
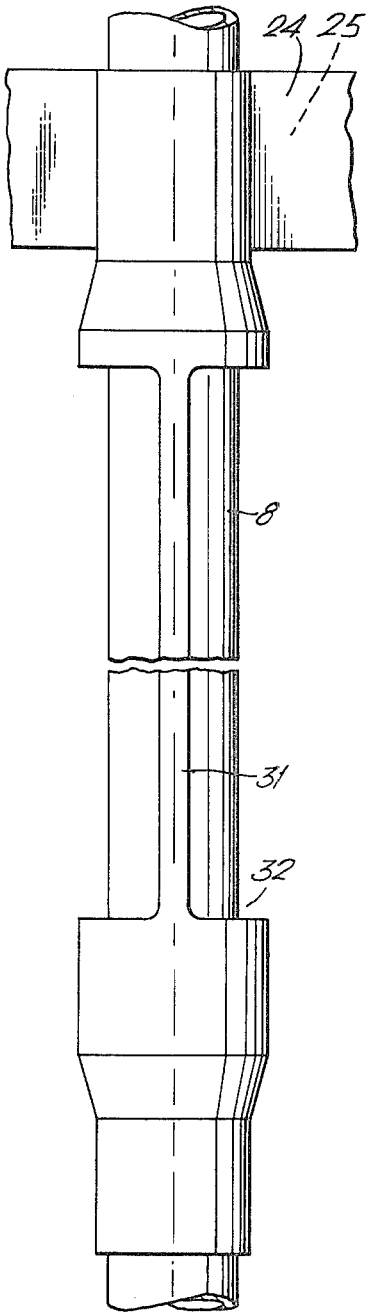

The straight portions of the legs of the 'U'-tubes 8 below the lower grid plates 24, 25 are supported by stiffening sleeves 31 as shown in FIGS. 9 and 10. The sleeves closely embrace the tubes at the upper and lower ends of the sleeves and the upper end of each sleeve is rigidly secured within a tube conducting cell of the lower grid plate 24, 25. Intermediate the ends the sleeves are spaced from the tubes and have windows 32 to enable liquid sodium to contact the tubes. The stiffening sleeves reduce to an acceptable level deflections of the 'U'-tubes caused by cross-flow induced vibration and buffetting from grid turbulence.

Figure 11:
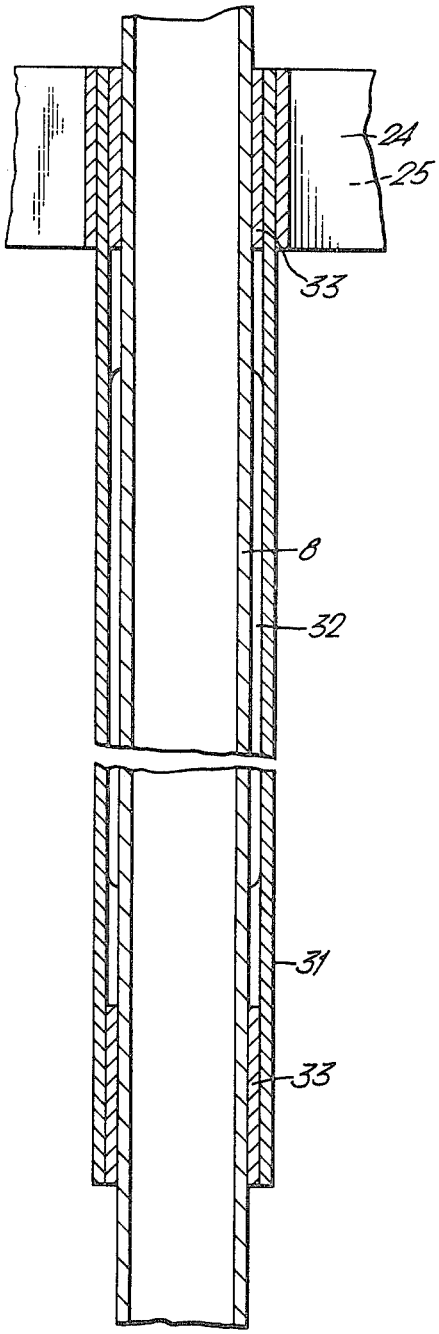
Figure 12:
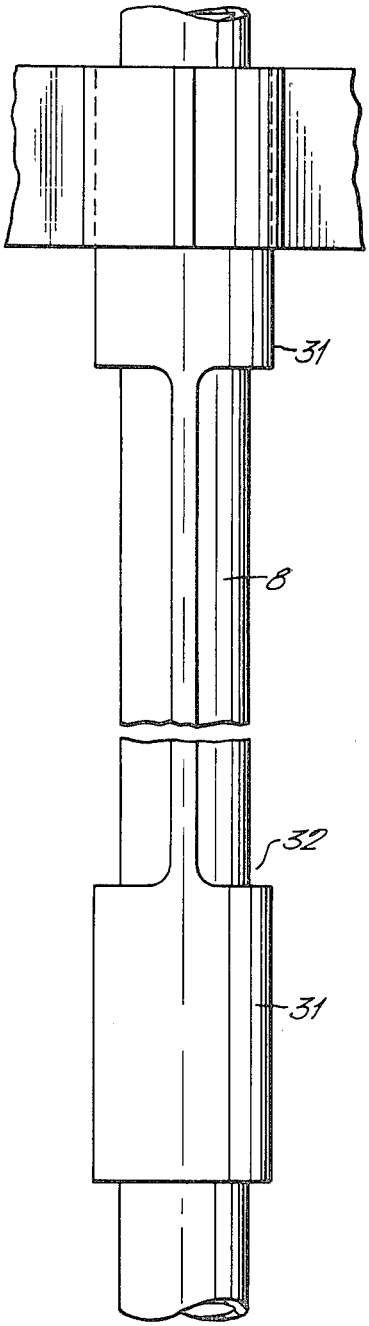

An alternative support sleeve arrangement shown in FIGS. 11 and 12 has bushes 33 of aluminised nickel base alloy intermediate the 'U'-tubes and the sleeves. The aluminised bearing surfaces of the bushes have a low coefficient of friction so that fretting damage due to thermal expansion induced longitudinal movement of the tubes and vibration is considerably reduced.

By adapting the heat exchange tubes 8 to the tube sheets 9, 10 by means of the sleeves 18 a tube sheet boundary between water and sodium is avoided. The complex stresses normally set up by a fusion welded tube to tube sheet joint are eliminated so that the tube sheet itself is not prone to stress corrosion cracking. A brazed joint between the sleeve and the tube avoids the use of fusion welds within the sodium water boundary and it can be readily made and stress relieved. The cover gas space in the top of the outer annulus of the shroud is carried up to the inner tube sheet and thereby maintains the temperature of the inner edge of the outer tube sheet at an acceptable level.

Figure 7:
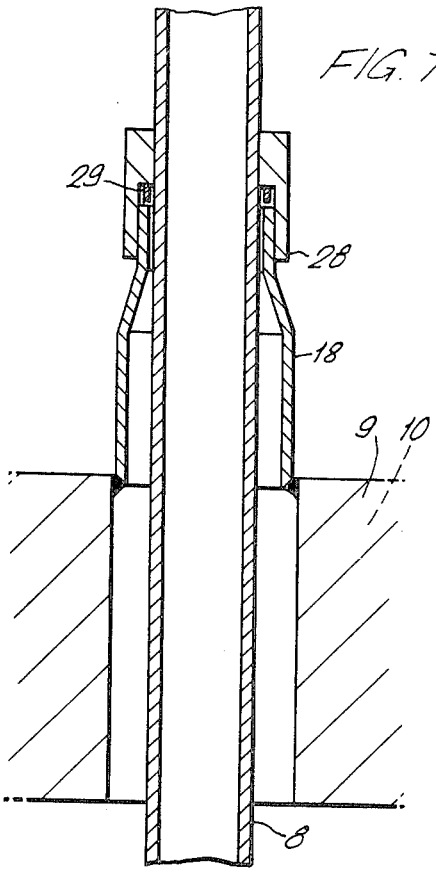
Figure 8:
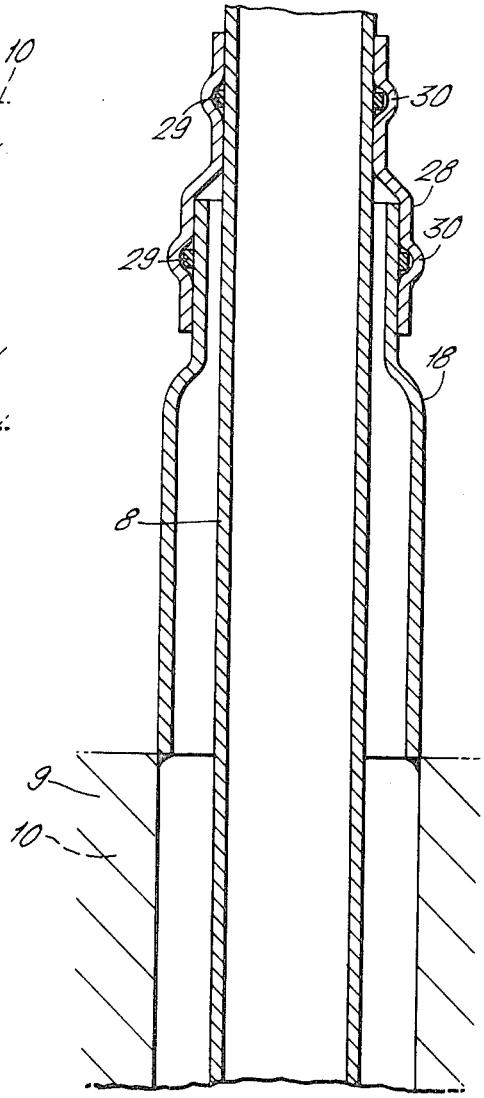

In alternative constructions of heat exchanger embodying the invention, a seal between each tube and the relevant sleeve is effected through a transition piece. Referring now to FIGS. 7 and 8 a tube 8 penetrates a tube sheet 9, 10 by means of a clearance aperture and is sealed to the tube sheet by a sleeve 18. The tube passes through the sleeve with substantial clearances at each end and there is a transition piece 28 in the form of a collar which is machined to make a close fit with the upper end of the sleeve and to the outer surface of the tube. The sleeve 18 is welded at the lower end to the tube sheet but is sealed to the tube 8 at the upper end by brazing the transition piece to the sleeve and tube. Braze material 29 may be interposed between the transition piece and the tube before applying heat to melt the braze material as shown in FIG. 7 or, alternatively, may be positioned in appropriately positioned grooves 30 in the transition piece as shown in FIG. 8. The brazing operation would, as in the previous embodiment, be carried out in an inert atmosphere and would also be stress relieved after the operation. Such constructions have the economic advantage that the multiplicity of tubes are more easily threaded through the sleeves during assembly of the construction prior to brazing.

In another alternative construction the tubes are sealed to the tube sheet by means of sleeves directed inwardly of the heat exchanger. Although the manufacture of heat exchangers with inwardly directed sleeves is more complex such heat exchangers have the advantage that multiple pockets which are difficult to decontaminate of sodium deposits are largely avoided.

The cellular grid plates of the described constructions are machined from plate but in conditions where a lower pressure drop through the shell is required cellular grids of a more complex form would be necessary and such plates could more economically be formed by a spark erosion technique.

We claim:

1. A heat exchanger comprising a shell adapted for conducting liquid metal and a bundle of heat exchange tubes within the shell for conducting water or steam, the shell having at least one tube sheet for passage of the tubes, each heat exchange tube extending through an individual aperture in the tube sheet with clearance between the tube and the tube sheet, the tube being sealed to the tube sheet by a sleeve upstanding from a face of the tube sheet and sealed at its free end to the outer wall surface of the tube, the tube and sleeve being bonded together by an interposed bonding metal to effect the seal, the bonding metal being of a kind not requiring, for the making of the bond, any recourse to temperature as high as would be required for the making of the joint by fusion welding.

2. A heat exchanger according to claim 1 wherein the tubes and sleeves are bonded together by brazing.

3. A heat exchanger comprising a shell adapted for conducting liquid metal and a bundle of heat exchange tubes within the shell for conducting water or steam, the shell having at least one tube sheet for passage of the tubes, all of the tubes entering the shell by passing with clearance through individual tube sheet apertures and all being in continuous unjointed lengths over the entire run within the shell, each of the tubes being sealed at each aperture by a sleeve upstanding from a face of the tube sheet and having at its free end a joint with the outer wall surface of the tube which joint is formed by an interposed bonding metal of a kind not requiring, for the making of the bond, any recourse to temperature as high as would be required for the making of the joint by fusion welding so as to alleviate impairment of the integrity of the tube wall and hence of the barrier between the liquid metal and heat transfer medium within the tube.

4. A heat exchanger according to claim 3 wherein the tubes and sleeves are bonded together with a nickel based alloy by brazing.

5. A heat exchanger according to claim 4 wherein each sleeve has a taper portion for forming, as the free end of the sleeve, a neck portion lapping the outer wall surface of the respective tube.

6. A heat exchanger according to claim 4 wherein each tube and complementary sleeve are bonded together indirectly through a tubular transition piece which is brazed at opposite extremities to the tube and sleeve respectively.

7. A heat exchanger according to claim 5 wherein the sleeves are directed inwardly of the heat exchanger shell.

8. A heat exchanger comprising an elongate vessel having inlet and outlet ports for liquid metal and housing a demountable heat exchange tube assembly, wherein the heat exchange tube assembly comprises:

a flanged extension forming a closure for the vessel, a bundle of U-shape heat exchange tubes having legs of unequal lengths suspended from the extension, an annular shroud arranged co-axially with the lengthwise axis of the bundle and enveloping the bundle of 'U'-tubes, a cylindrical baffle suspended from the extension and defining inner and outer annular chambers in the shroud, and means for laterally supporting the 'U'-tubes from the baffle, the limbs of the 'U'-tubes extending parallel with the longitudinal axis of the vessel, a longer limb of each tube extending along the inner chamber of the shroud to penetrate an end wall of the extension which thereby forms a first tube sheet of the heat exchanger, and a shorter limb of each tube extending along the outer chamber of the shroud to penetrate the flange of the extension which thereby forms a second tube sheet of the heat exchanger, each leg of each tube penetrating a complementary tube sheet through an individual aperture with a clearance between the tube and the tube sheet, the tube being sealed to the tube sheet by a sleeve upstanding from a face of the tube sheet and sealed at its free end to the outer wall surface of the tube, the tube and sleeve being brazed together to effect a seal.

9. A heat exchanger according to claim 8 wherein the means for laterally supporting the 'U'-tubes from the baffle comprises a series of axially spaced cellular grids supported by the cylindrical baffle and penetrated by the heat exchange tubes, a series of angularly spaced anti-vibration plates associated with each grid, the anti-vibration plates having apertures penetrated by the tubes, and draw means for displacing the anti-vibration plates radially relative to the grids to bear laterally against tubes.

10. A heat exchanger according to claim 9 wherein at least some of the 'U'-tubes have stiffening sleeves for supporting the 'U'-bends of the tubes against vibration, the stiffening sleeves depending from the grid plate adjacent the 'U'-bends and extending towards the 'U'-bends.

11. A heat exchanger according to claim 10 wherein aluminised nickel base alloy bushes are interposed between each stiffening sleeve and its complementary tube.

12. A method of constructing a heat exchanger comprising an elongate vessel having inlet and outlet ports for liquid metal and housing a demountable heat exchange tube assembly, wherein the heat exchange tube assembly comprises:

a flanged extension forming a closure for the vessel, a bundle of U-shaped heat exchange tubes having legs of unequal lengths suspended from the extension, an annular shroud arranged co-axially with the lengthwise axis of the bundle and enveloping the bundle of 'U'-tubes, a cylindrical baffle suspended from the extension and defining inner and outer annular chambers in the shroud, and means for laterally supporting the 'U'-tubes from the baffle, the limbs of the 'U'-tubes extending parallel with the longitudinal axis of the vessel, a longer limb of each tube extending along the inner chamber of the shroud to penetrate an end wall of the extension which thereby forms a first tube sheet of the heat exchanger, and a shorter limb of each tube extending along the outer chamber of the shroud to penetrate the flange of the extension which thereby forms a second tube sheet of the heat exchanger, each leg of each tube penetrating a complementary tube sheet through an individual aperture with a clearance between the tube and the tube sheet, the tube being sealed to the tube sheet by a sleeve upstanding from a face of the tube sheet and sealed at its free end to the outer wall surface of the tube, the tube and sleeve being brazed together to effect a seal, the method including the steps of brazing each tube and sleeve combination individually using radio frequency electric induction heating means with an inert gas atmosphere enveloping the joint being brazed.

* * * * *